US006053802A

United States Patent [19]

Yi et al.

[11] Patent Number: 6,053,802

[45] Date of Patent: Apr. 25, 2000

[54] STABILIZATION OF SLURRY USED IN CHEMICAL MECHANICAL POLISHING OF SEMICONDUCTOR WAFERS BY MEGASONIC PULSE

[75] Inventors: Champion Yi, Hsinchu Hsien; Jen-Chieh Tung, Hsinchu; Jiun-Fang Wang, Hsin-chu, all of Taiwan

[73] Assignees: ProMos Technologies, Inc.; Mosel Vitelic, Inc., both of Hsinchu, Taiwan; Siemens AG, Muchen, Germany

[21] Appl. No.: 09/324,689

[22] Filed: Jun. 3, 1999

[51] Int. Cl.[7] ..... B24B 7/19; B24B 7/30

[52] U.S. Cl. ..... 451/60; 451/28; 451/910

[58] Field of Search ..... 366/111, 112, 366/114, 113, 116, 127; 134/2, 25.4, 26, 30, 31, 37, 902; 204/157.15, 157.42; 205/742, 748, 770, 755, 756; 451/271, 28, 60, 99, 165, 910; 125/16.02, 21

[56] References Cited

U.S. PATENT DOCUMENTS

| | | | |
|---|---|---|---|
| 5,201,305 | 4/1993 | Takeuchi | 125/21 |
| 5,746,646 | 5/1998 | Shibano | 451/36 |

FOREIGN PATENT DOCUMENTS

| | | |
|---|---|---|
| 6224559 | 2/1987 | Japan . |
| 7285073 | 10/1995 | Japan . |

*Primary Examiner*—Derris Holt Banks

*Attorney, Agent, or Firm*—Blakely, Sokoloff, Taylor & Zafman, LLP

[57] ABSTRACT

A method and apparatus for conditioning a slurry used in a chemical mechanical polishing apparatus is disclosed. Megasonic generators are provided along the piping network between a slurry reservoir and the CMP apparatus. A megasonic generator may also be placed adjacent to the slurry reservoir. The megasonic generators discourage the formation of agglomerate particles, which in turn reduces the number of defects caused by the large particles in the slurry.

4 Claims, 1 Drawing Sheet

STABILIZATION OF SLURRY USED IN CHEMICAL MECHANICAL POLISHING OF SEMICONDUCTOR WAFERS BY MEGASONIC PULSE

FIELD OF THE INVENTION

The present invention relates to slurries used in chemical mechanical polishing, and more particularly, to a method for discouraging the formation of agglomerate particles in the slurry using megasonic pulses.

BACKGROUND OF THE INVENTION

Chemical mechanical polishing is one of the many steps commonly used in the manufacture of integrated circuits. As detailed in many prior art patents, chemical mechanical polishing, or simply "CMP," is the process of polishing the surface of a semiconductor wafer in order to remove material from the surface of the wafer. The polishing is typically performed by rotating a polishing pad against the semiconductor wafer. A slurry of some sort is used to facilitate the polishing process. Depending upon the material that is to be removed from the semiconductor wafer, the composition of the polishing pad and the composition of the slurry varies.

For example, in the CMP of tungsten material from the surface of a wafer, the slurry will include an oxidizer, which is typically ferric nitrate crystals ($Fe(NO_3)_3$). The ferric nitrate crystals are usually diluted in deionized water and then mixed with aluminum oxide ($Al_2O_3$) before being introduced into the CMP apparatus. Examples of slurry compositions are detailed in U.S. Pat. No. 5,783,489 to Kaufman et al. and the patents cited therein.

These slurries shown in the '489 patent and other slurries typically include silica, alumina, ceria, titania, and/or zirconia abrasive particles. These particles are suspended in a liquid naturally or by adding a surfactant. Nevertheless, one known problem with CMP slurries is that, for a variety of reasons, the particulates in the slurry may gel or flocculate. The flocculation may result from a change in pH level, heat, light, sedimentation in the delivery system at low flow rates, shear forces, metal contaminants, and other particle interaction. If this occurs, the agglomerate particles may scratch the surface of the wafer. These defects can result in short circuiting of metal interconnect layers. The defects may be singular or may be of the "skipping stone" type.

Therefore, what is needed is a method of minimizing the amount of agglomeration of particles in the CMP slurry.

SUMMARY OF THE INVENTION

A method and apparatus for conditioning a slurry used in a chemical mechanical polishing apparatus is disclosed. Megasonic generators are provided along the piping network between a slurry reservoir and the CMP apparatus. A megasonic generator may also be placed adjacent to the slurry reservoir. The megasonic generators discourage the formation of agglomerate particles, which in turn reduces the number of defects caused by the large particles in the slurry.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
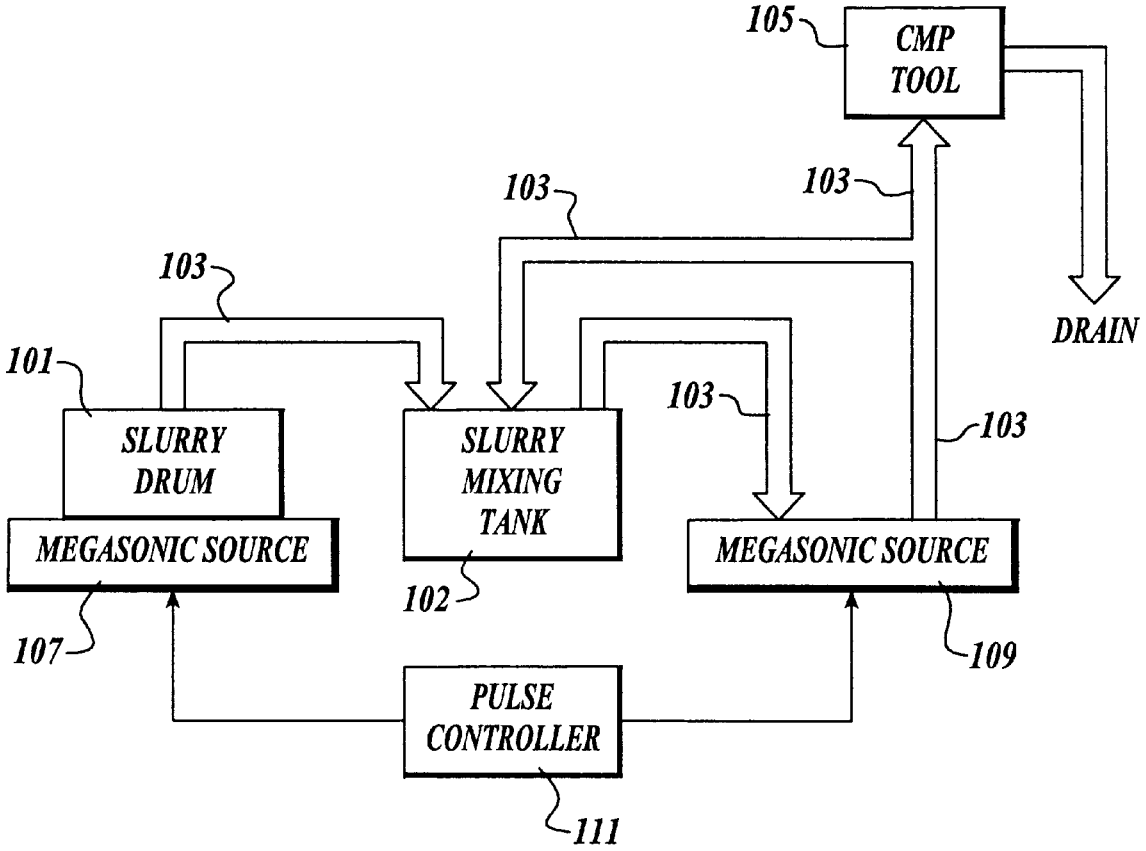
FIG. 1 illustrates in the preferred embodiment of the present invention.

As noted above, it is believed that large agglomerated particulates cause defects to be formed on the semiconductor wafer during the polishing process. Thus, the goal of the present invention is to prevent the formation of these particulates in the slurry. Although extremely fine mesh physical filters may be used to filter the agglomerate particles, because the particles can be extremely small, the filtering may be ineffective, or may be cost-prohibitive. Therefore, the present invention provides a method for reducing or eliminating the amount of agglomerate particles in the slurry delivered to the CMP apparatus.

Turning to FIG. 1, a slurry reservoir 101 is shown. The slurry reservoir provides slurry through a piping system 103 to a CMP tool 105. Also included is a slurry mixing tank 102. The slurry reservoir 101, the slurry mixing tank 102, the piping system 103, and the CMP tool 105 are of conventional design.

In accordance with the present invention, a megasonic source 107 is placed under the slurry reservoir. The megasonic source 107 is preferably a sonicator that produces vibrational energy in the frequency range of 5 KHz to 5 MHz. A suitable sonicator may be purchased from Perkin-Elmer Corp of Norwalk, Conn. When activated, the megasonic source 107 serves to introduce vibrational energy into the slurry reservoir 101.

It has been found that the vibrational energy produced by the megasonic source 107 discourages the formation of the agglomerate particles in the slurry drum. In addition, a megasonic source can also be put along various locations of the piping system 103. In particular, a megasonic source 109 can be placed in regions of the piping 103 that are near bends or have comers. This provides a megasonic vibration that attracts breaks up the agglomerated particles prior to entering the CMP tool. It can be appreciated that megasonic sources can be placed throughout the entire length of the piping 103 or at any other position along the piping 103.

It has been found that the use of megasonic energy in accordance with the present invention significantly reduces the amount of agglomerated particles in the slurry delivered to the CMP tool 105. Additionally, although it may be intuitive to have the megasonic source operate continuously, the inventors have found that by pulsing the megasonic sources 107 and 109, the efficacy is improved. Indeed, experimental results indicate that if the megasonic sources 107 and 109 are on continuously, additionally agglomeration occurs. It is believed that the constant agitation will result in an increased particle collision rate and elevated temperature. Therefore, in the preferred embodiment, the megasonic sources 107 and 109 are controlled by a pulse controller 111 that selectively and periodically activates the megasonic sources 107 and 109. Preferably, the pulse controller 111 is operative to turn on the megasonic sources 107 and 109 for a period of 1–3 minutes followed by an off cycle of 1–5 minutes.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of reducing agglomerated particles in a slurry for use in a chemical mechanical polishing process, the method comprising the step of:

providing a megasonic source adjacent to a slurry reservoir, said slurry reservoir holding said slurry, wherein said megasonic source produces a vibration that penetrates said slurry reservoir, said megasonic source operating at a frequency of between 5 KHz and 5 MHz, further wherein said megasonic source is used periodically at a duty cycle of 1–3 minutes on followed by 1–5 minutes off.

2. The method of claim 1 further including the step of providing a second megasonic source along at least a portion of a piping system that carries said slurry from said slurry reservoir to a CMP tool.

3. A slurry delivery system for delivering slurry to a chemical mechanical polishing tool, the system comprising:

a slurry reservoir for holding a volume of slurry;

a piping system for delivering said slurry to said chemical mechanical polishing tool; and a megasonic source located adjacent to said slurry reservoir so as to provide a vibration that penetrates said slurry reservoir, said megasonic source operating at a frequency of between 5 KHz and 5 MHz, further wherein said megasonic source is used periodically at a duty cycle of 1–3 minutes on followed by 1–5 minutes off.

4. The system of claim 3 further including a second megasonic source located adjacent to at least a portion of said piping system, said second megasonic source producing a vibration that penetrates said piping system.

* * * * *